US005975397A

United States Patent [19]

Van Erden et al.

[11] Patent Number: 5,975,397

[45] **Date of Patent: *Nov. 2, 1999**

[54] HIGH VELOCITY, COMBUSTION-POWERED, FASTERNER-DRIVING TOOL

[75] Inventors: Donald L. Van Erden, Wildwood; Kui-Chiu Kwok, Mundelein; G. Michael Volan, Mt. Prospect, all of Ill.

[73] Assignee: Illinois Tool Works, Inc., Glenview, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,336

[22] Filed: Oct. 17, 1997

Related U.S. Application Data

[62] Division of application No. 08/536,854, Sep. 29, 1995, Pat. No. 5,722,578.

[51] Int. Cl.[6] ..... B25C 1/04

[52] U.S. Cl. ..... 227/10; 227/130

[58] Field of Search ..... 227/8, 9, 10, 130

[56] References Cited

U.S. PATENT DOCUMENTS

| | | | |
|---|---|---|---|
| Re. 32,452 | 7/1987 | Nikolich | 123/46 SC |
| 620,287 | 2/1899 | Donnelly . | |
| 895,155 | 8/1908 | Burgess, Jr. . | |
| 1,366,448 | 1/1921 | Erickson . | |
| 1,378,353 | 5/1921 | Hutsell . | |
| 2,655,901 | 5/1953 | Brown | 121/18 |
| 2,995,113 | 8/1961 | Steiner | 121/13 |
| 3,010,430 | 11/1961 | Allen et al. | 121/13 |
| 3,040,326 | 6/1962 | DeCaro | 227/10 |
| 3,042,008 | 7/1962 | Liesse | 123/7 |
| 3,074,071 | 1/1963 | DeCaro | 227/10 |
| 3,133,287 | 5/1964 | Kopf | 227/10 |
| 3,424,361 | 1/1969 | Bayer | 227/10 |
| 3,468,465 | 9/1969 | Mulno . | |
| 3,497,124 | 2/1970 | Temple et al. | 227/10 |
| 3,828,656 | 8/1974 | Biddle et al. | 92/85 |
| 3,850,359 | 11/1974 | Obergfell | 227/10 |

(List continued on next page.)

FOREIGN PATENT DOCUMENTS

| | | |
|---|---|---|
| 366803 | 2/1963 | Germany . |
| 44 09 755 A1 | 3/1994 | Germany . |
| 358390 | 11/1961 | Switzerland . |
| 366803 | 1/1963 | Switzerland . |
| 366803 | 2/1963 | Switzerland . |
| 500 816 | 12/1970 | Switzerland . |
| 2 020 747 | 11/1979 | United Kingdom . |

*Primary Examiner*—Scott A. Smith
*Attorney, Agent, or Firm*—Rockey, Milnamow & Katz, Ltd.

[57] ABSTRACT

In a combustion-powered, fastener-driving tool with a combustion chamber, a piston chamber communicating with the combustion chamber, a driving piston movable within the piston chamber between an initial position and a terminal position, and a driving blade mounted to the driving piston so as to be conjointly movable with the driving piston, the driving piston, the driving blade, and the piston chamber are arranged so that combustion in the combustion chamber imparts energy to the driving piston and the driving blade so as to drive the driving piston and the driving blade from the initial position toward the terminal position with the driving blade preceding the driving piston, over a stroke having a length sufficient to enable the driving blade to transfer more than eight tenths of the maximum, transferable energy to a fastener engaged by the driving blade as the driving piston and the driving blade approach the terminal position. The piston chamber has an inner, cylindrical wall. The driving piston has an annular portion with an annular groove seating a piston ring or has two axially spaced, annular portions, at least one of which has an annular groove seating a piston ring engaging the inner, cylindrical wall. The driving piston, the driving blade, and the piston chamber are arranged so that the driving piston and the driving blade are guided solely within the axial length of the driving piston, over at least substantially all of the stroke.

10 Claims, 5 Drawing Sheets

U.S. PATENT DOCUMENTS

| | | | |
|---|---|---|---|
| 3,902,238 | 9/1975 | Monson | 29/432 |
| 3,915,242 | 10/1975 | Bell | 173/134 |
| 3,918,619 | 11/1975 | Termet | 227/8 |
| 3,953,398 | 4/1976 | Haytayan | 29/432 |
| 3,967,771 | 7/1976 | Smith | 227/10 |
| 4,068,790 | 1/1978 | Osterle et al. | 227/10 |
| 4,153,192 | 5/1979 | Jochum | 227/10 |
| 4,159,070 | 6/1979 | Monson | 227/10 |
| 4,192,391 | 3/1980 | Kastreuz et l. | 173/116 |
| 4,286,496 | 9/1981 | Harris | 411/441 |
| 4,405,072 | 9/1983 | Kindle et al. | 227/10 |
| 4,687,126 | 8/1987 | Brosius et al. | 227/10 |
| 4,762,051 | 8/1988 | Besic et al. . | |
| 4,867,252 | 9/1989 | Sudnishnikov et al. | 173/121 |
| 4,890,778 | 1/1990 | Hawkins | 227/10 |
| 4,913,331 | 4/1990 | Utsumi et al. | 227/10 |
| 5,029,744 | 7/1991 | Pai | 227/9 |
| 5,038,665 | 8/1991 | Aske et al. | 89/1.14 |
| 5,170,922 | 12/1992 | Ehmig et al. . | |
| 5,181,450 | 1/1993 | Monacelli | 91/41 |
| 5,197,646 | 3/1993 | Nikolich | 227/8 |
| 5,213,247 | 5/1993 | Gschwend et al. | 227/10 |
| 5,220,123 | 6/1993 | Ohery | 89/1.14 |
| 5,239,829 | 8/1993 | Blake . | |
| 5,329,839 | 7/1994 | Ehmig | 89/1.14 |
| 5,332,140 | 7/1994 | Almeras et al. | 227/10 |
| 5,484,094 | 1/1996 | Gupta | 227/8 |
| 5,558,264 | 9/1996 | Weinstein | 227/10 |
| 5,597,106 | 1/1997 | Hamano et al. | 227/130 |
| 5,651,489 | 7/1997 | Janssen et al. | 227/10 |
| 5,752,643 | 5/1998 | MacVicar et al. | 227/10 |

FIG. 1
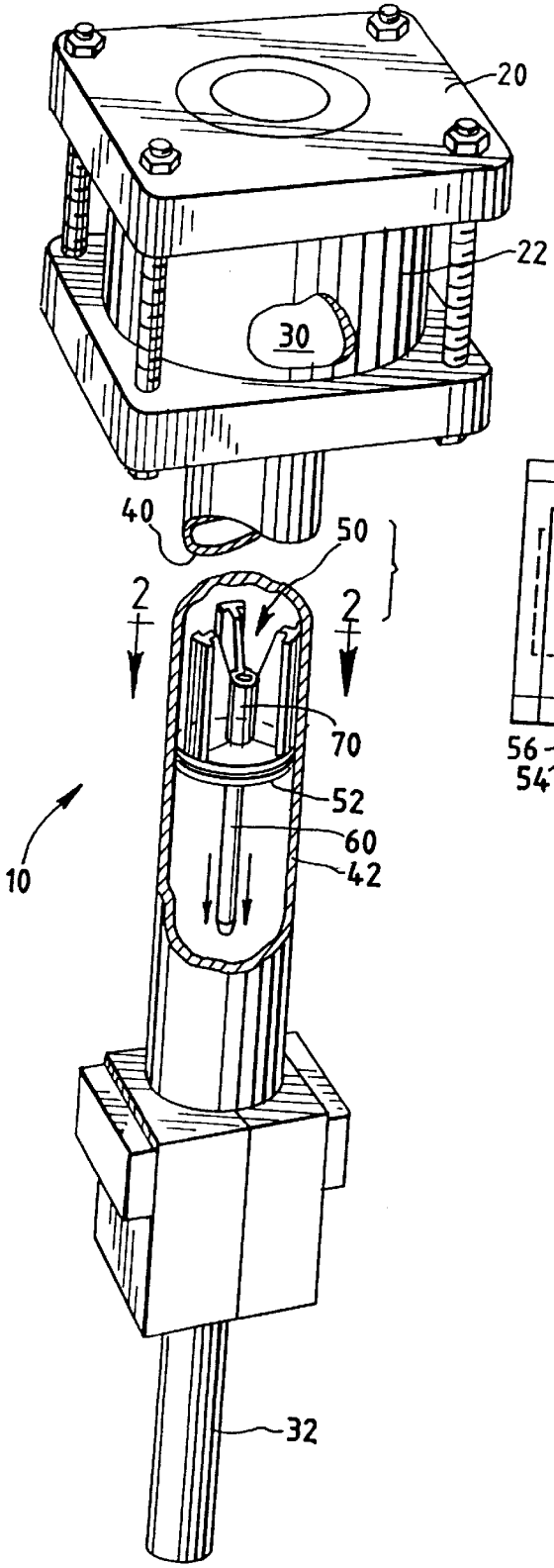
FIG. 2
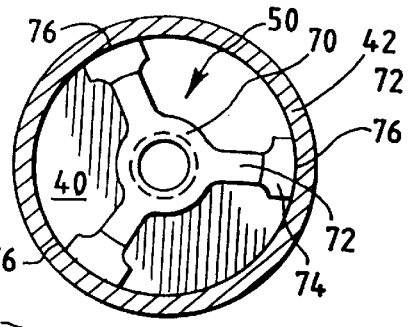
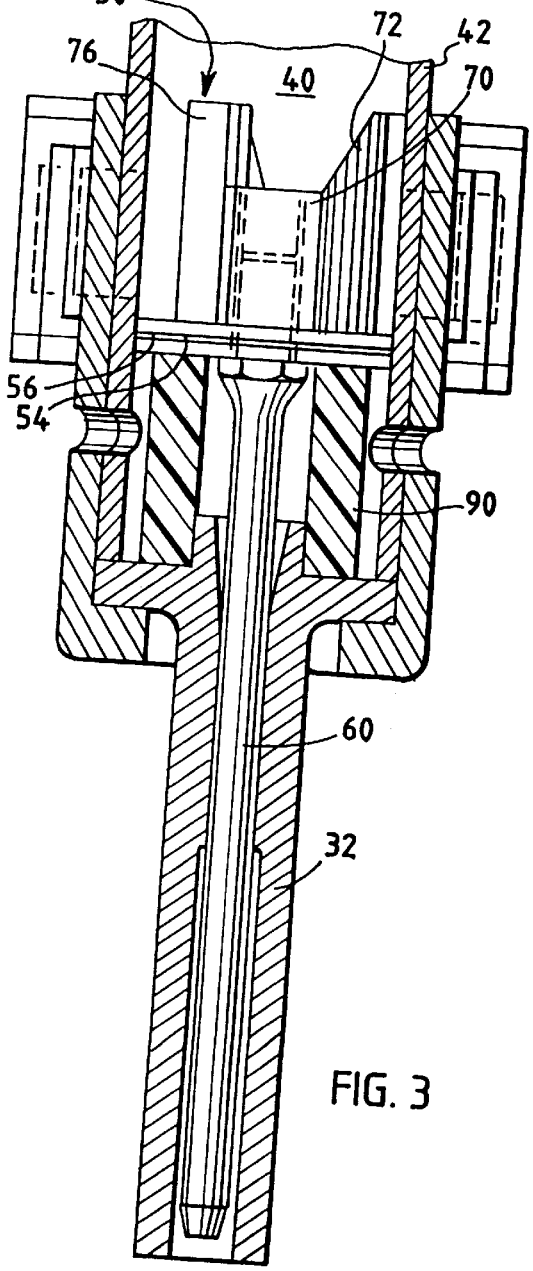
FIG. 3

HIGH VELOCITY, COMBUSTION-POWERED, FASTERNER-DRIVING TOOL

This application is a division of application Ser. No. 08/536,854 filed Sep. 29, 1995 which application is now: U.S. Pat. No. 5,722,578.

TECHNICAL FIELD OF THE INVENTION

This invention pertains to a high velocity, combustion-powered, fastener-driving tool, in which a driving piston, a driving blade, and a piston chamber are arranged so that combustion of a fuel in a combustion chamber imparts energy to the driving piston and the driving blade so as to drive the driving piston and the driving blade over a stroke having a length sufficient to enable the driving blade to transfer more than one half of the maximum, transferable energy to a fastener, and so that the driving piston and the driving blade are guided solely within the axial length a of the driving piston, over at least substantially all of the stroke.

BACKGROUND OF THE INVENTION

Combustion-powered, fastener-driving tools of a type exemplified in Nikolich U.S. Pat. No. Re. 32,452 and Nikolich U.S. Pat. No. 5,197,646 are available commercially from ITW Paslode (a unit of Illinois Tool Works Inc.) of Vernon Hills, Ill., and are used widely in building construction.

Typically, such a tool comprises a combustion chamber, a piston chamber communicating with the combustion chamber, a driving piston movable within the piston chamber over a stroke between an initial position and a terminal position, and a driving blade mounted to the driving piston so as to be conjointly movable with the driving piston. Combustion in the combustion chamber imparts energy to the driving piston and the driving blade so as to drive the driving piston and the driving blade over a stroke from an initial position toward a terminal position with the driving blade preceding the driving piston. Typically, the driving blade is guided by passing through or between guides, over the entire stroke of the driving blade.

Generally, such a tool also comprises means for sensing when the tool is pressed against a workpiece, for enabling the tool when the tool is pressed against a workpiece, and for disabling the tool when the tool is not pressed against a workpiece, together with means including a trigger for initiating combustion in the combustion chamber when the tool is enabled and the trigger is actuated.

It has been found that such tools known heretofore transfer less than one half of the maximum, transferable energy to a fastener engaged by the driving blade as the driving piston and the driving blade approach the terminal position. It would be highly desirable to provide such a tool that could transfer substantially more of the maximum, transferable energy to a fastener engaged by the driving blade as the driving piston and the driving blade approach the terminal position.

SUMMARY OF THE INVENTION

A first aspect of this invention stems from a discovery that increasing the ratio of the piston displacement volume to the combustion chamber volume, as by lengthening the stroke of the piston, increases the fraction of the imparted energy that can be thus transferred until a maximum, transferable energy is approached, whereupon such fraction begins to fall as such ration is increased further. A second aspect of this invention stems from a discovery that, since friction within the tool affects the fraction of the imparted energy that can be thus transferred and since the driving blade tends to buckle if elongated excessively, it is advantageous for the driving piston and the driving blade to be guided solely within the axial length of the driving piston, over substantially all of the stroke, so as to minimize friction within the tool.

According to the first aspect of this invention, this invention provides a combustion-powered, fastener-driving tool of the type noted above, wherein the driving piston, the driving blade, and the piston chamber are arranged so that combustion in the combustion chamber having a combustion chamber volume imparts energy to the driving piston and the driving blade so as to drive the driving piston and the driving blade from the initial position toward the terminal position, through a piston displacement volume, with the driving blade preceding the driving piston, wherein the ratio of the piston displacement volume to the combustion chamber volume is sufficient to enable the driving blade to transfer more than one half of the maximum, transferable energy to a fastener engaged by the driving blade as the driving piston and the driving blade approach the terminal position, preferably being sufficient to enable the driving blade to transfer more than eight tenths of the maximum, transferable energy to a fastener engaged by the driving blade as the driving piston and the driving blade approach the terminal position. The ratio of the piston chamber volume to the combustion chamber volume can be advantageously increased by lengthening the stroke of the piston.

According to the second aspect of this invention, this invention provides a combustion-powered, fastener-driving tool of the type noted above, wherein the driving piston, the driving blade, and the piston chamber are arranged so that the driving piston and the driving blade are guided solely within the axial length of the driving piston, over at least substantially all of the stroke.

Preferably, the piston chamber has an inner, cylindrical wall, and the driving piston has an annular portion with an annular groove, in which a piston ring is seated and engages the inner, cylindrical wall.

These and other objects, features, and advantages of this invention are evident from the following description of two contemplated embodiments of this invention with reference to the accompanying drawings.

BRIEF DESCRIPTION OF THE DRAWINGS

FIG. 1 is a perspective, schematic view of elements of a high velocity, combustion-powered, fastener-driving tool constituting one contemplated embodiment of this invention.

FIG. 2, on a larger scale, is a sectional view taken along line 2—2 of FIG. 1, in a direction indicated by arrows.

FIG. 3, on a similar scale, is a fragmentary, cross-sectional view taken through an axis of the tool shown in FIG. 1.

DETAILED DESCRIPTION OF THE ILLUSTRATED EMBODIMENTS

Figure 5:
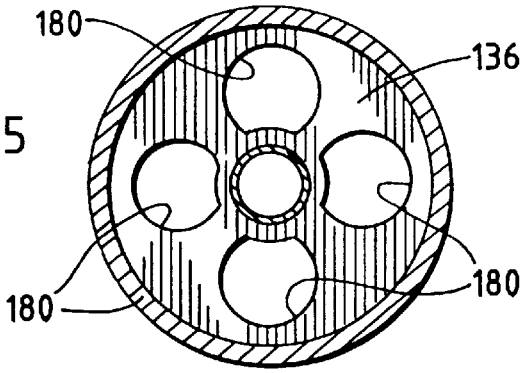
FIG. 5 is a sectional view taken along line 5—5 of FIG. 4, in a direction indicated by arrows.

As shown schematically in FIGS. 1, 2, and 3, a high velocity, combustion-powered, fastener-driving tool 10 of the type noted above constitutes one contemplated embodiment of this invention. Except as illustrated and described herein, the tool 10 may be substantially similar to one of the combustion-powered, fastener-driving tools disclosed in Nikolich U.S. Pat. Nos. Re. 32,452 and No. 5,197,646, the disclosures of which are incorporated herein by reference.

Being of the type noted above and deriving motive power from combustion of a gaseous fuel, the tool 10 comprises a housing structure 20 and a cylinder body 22, which is mounted fixedly within the housing structure 20, and which defines a combustion chamber 30, a piston chamber 40 communicating with the combustion chamber 30, and a nosepiece 32 communicating with the piston chamber 40. The combustion chamber 30, the piston chamber 40, and the nosepiece 32 define an axis of the tool 10. The combustion chamber 30 is adapted to contain a mixture of such a fuel and air. The nosepiece 32 is adapted to receive a fastener and to guide the fastener as the fastener is driven.

Moreover, the tool 10 comprises a driving piston 50 movable axially within the piston chamber 40 over a stroke between an initial position, which is an upper position in the drawings, and a terminal position, which is a lower position in the drawings. The driving piston 50 has an axial length, to which reference is to be later made. Furthermore, the tool 10 comprises a driving blade 60, which is mounted to the driving piston 50 so as to be conjointly movable with the driving piston 50. Generally, the terminal position is defined by an annular, elastomeric bumper 90, which is arranged to arrest the driving piston 50 as the driving piston 50 and the driving blade 60 approach the terminal position. The combustion chamber 30 has a volume, which is measured with the driving piston 50 and the driving blade 60 in the initial position. As the driving piston 50 and the driving blade 60 are moved from the initial position into the terminal position, the driving piston 50 is displaced through a volume, which may be conveniently called the piston displacement volume.

As disclosed in Nikolich U.S. Pat. No. 5,197,646 noted above, the tool 10 comprises means including a workpiece-contacting element for sensing when the tool is pressed against a workpiece, for enabling the tool 10 when the tool 10 is pressed against a workpiece, and for disabling the tool 10 when the tool 10 is not pressed against a workpiece, means including a trigger for initiating combustion of a gaseous fuel mixed with air in the combustion chamber 30 when the trigger is actuated. Details of these means and other elements of the tool 10 are outside the scope of this invention and can be readily supplied by persons having ordinary skill in the art from the Nikolich patents noted above and from other sources.

Figure 7:
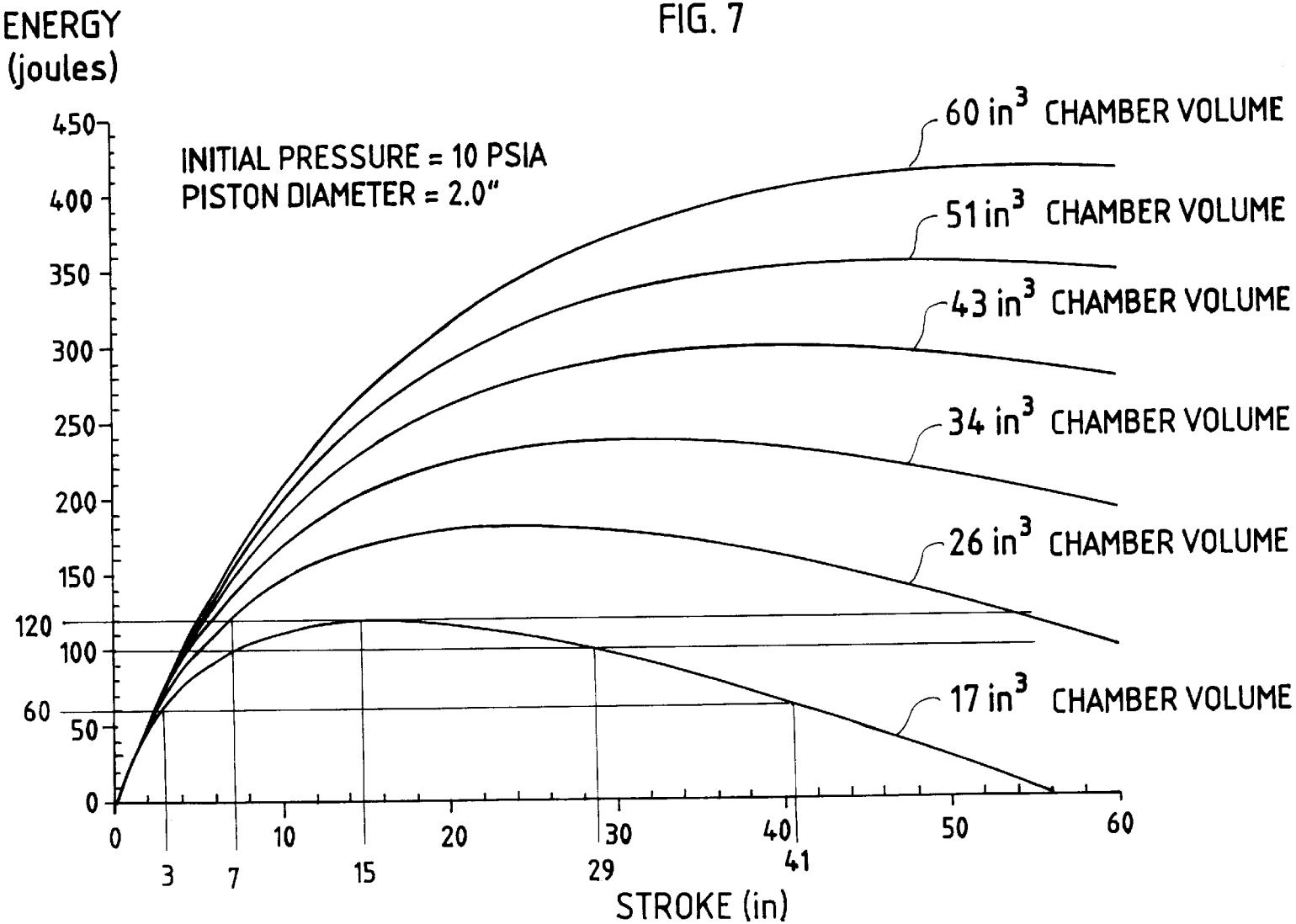
FIG. 7 is a graph of piston chamber volume versus energy (joules) for such tools having combustion chambers of six different volumes.

As discussed above, the first aspect of this invention stems from the discovery that increasing the ratio of the piston displacement volume to the combustion chamber volume, as by lengthening the stroke of the piston, increases the fraction of the imparted energy that can be thus transferred until a maximum, transferable energy is approached, whereupon such fraction begins to fall. This discovery is illustrated by the graph of FIG. 7, which shows the energy transferable by a driving blade to a fastener at strokes of different lengths, for combustion-powered, fastener-driving tools of the type noted above with different combustion chamber volumes, and by the graph of FIG. 8, which shows the energy transferable by a driving blade to a fastener at different piston displacement volumes for combustion-powered, fastener-driving tools of the type noted above with different combustion chamber volumes. All numbers shown on the graphs (FIGS. 7 and 8) are approximate.

According to the first aspect of this invention, the driving piston 50, the driving blade 60, and the piston chamber 40 are arranged so that combustion in the combustion chamber 30 imparts energy to the driving piston 50 and the driving blade 60 so as to drive the driving piston 50 and the driving blade 60 from the initial position toward the terminal position with the driving blade 60 preceding the driving piston 50, over a stroke having a length sufficient to enable the driving blade 60 to transfer more than one half of the maximum, transferable energy to a fastener engaged by the driving blade 60 as the driving piston 50 and the driving blade 60 approach the terminal position, preferably over a stroke having a length sufficient to enable the driving blade 60 to transfer more than eight tenths of the maximum, transferable energy to a fastener engaged by the driving blade 60 as the driving piston 50 and the driving blade 60 approach the terminal position.

As an example of such tools known heretofore, one model of a combustion-powered, fastener-driving tool available commercially from Illinois Tool Works Inc. has a combustion chamber with a volume of approximately 17 cubic inches and a stroke of approximately 3.5 inches, utilizes a given quantity of a gaseous fuel, and is capable of transferring approximately 50 joules to a fastener, which energy (50 joules) is approximately 0.417 (less than one half) of the maximum energy (120 joules) transferable in such a tool. As an example of such tools embodying this invention, an experimental, combustion-powered, fastener-driving tool having a combustion chamber with a volume of approximately 17 cubic inches but a stroke of approximately seven inches and utilizing approximately the same quantity of the same fuel is capable of transferring approximately 100 joules to a fastener, which energy (100 joules) is approximately 0.833 times (more than eight tenths) of the maximum energy (120 joules) transferable in such a tool.

As demonstrated in FIG. 7 the maximum transferrable energy for the 17 $in^3$ chamber volume is 120 joules. This maximum corresponds to a stroke of 15 inches for a 2 inch diameter piston. A horizontal line at 60 joules (one half of the maximum transferrable energy) intersects the 17 $in^3$ curve at approximately 3 inches stroke and approximately 41 inches stroke. A horizontal line through 100 joules (83.3% of the maximum transferrable energy) intersects the 17 $in^3$ curve at approximately 7 inches stroke and 29 inches stroke.

For maximum transferrable energy the ratio of stroke to piston diameter is approximately 7.5:1. For the 50% transferrable energy range (60 joules) the ratio of stroke to piston diameter is between 1.5:1 and 20.5:1. Taking the 83.3% transferrable energy range (100 joules) the ratio of stroke to piston diameter is between 3.5:1 and 14.5:1. The piston diameter is 2 inches.

Figure 8:
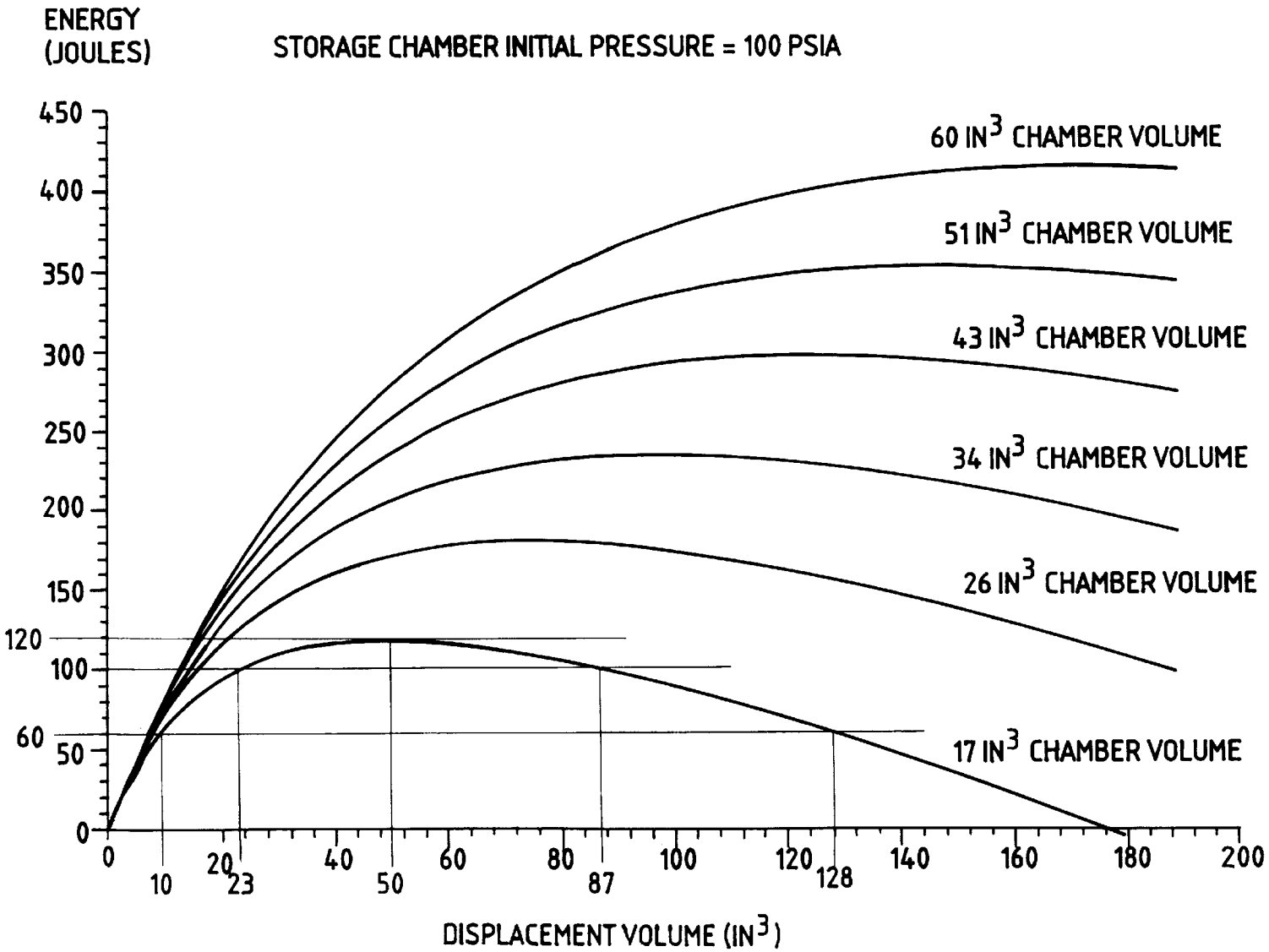
FIG. 8 is a graph of (inches) versus energy (joules) for such tools having combustion chambers of six different volumes.

Reviewing FIG. 8, the maximum transferrable energy is again 120 joules for the 17 $in^3$ chamber volume. This maximum corresponds to a displacement volume of 50 $in^3$. A line across 60 joules (50% maximum transferrable energy) intersects the 17 $in^3$ curve at 10 $in^3$ and 128 $in^3$. A line across 100 joules (83.3% maximum transferrable energy) intersects the 17 $in^3$ curve at approximately 23 $in^3$ and 87 $in^3$.

The ratio of piston displacement volume to combustion chamber volume for maximum transferrable energy is approximately 3. For the ratio range for a 50% transfer of energy, the ratio of piston displacement volume to combustion chamber volume is between 0.59:1 and 7.53:1. For the ratio range for the 83.3% conversion of energy (100 joules), the ratio of piston displacement volume to combustion chamber volume is between 1.35:1 and 5.12:1.

As discussed above, the second aspect of this invention stems from a discovery that for reducing friction within such a tool so as to increase the fraction of the maximum, transferable energy that can be thus transferred it is advantageous for the driving piston 50 and the driving blade 60 to be guided solely within the axial length of the driving piston 50, over substantially all of the stroke.

Thus, the piston chamber 40 has an inner, cylindrical wall 42, and the driving piston 50 has an annular portion 52 with an annular groove 54, in which a piston ring 56 is seated. The piston ring 56 engages the inner, cylindrical wall 42, so as to provide a gas-tight seal between the driving piston 50 and the cylindrical wall 42 as the driving piston 50 and the driving blade 60 are driven axially. The driving piston 50, which has a small mass, has a central hub 70, which trails the annular portion 52, three radial arms 72, which radiate from the central hub 70, and three axially extending guides 74, each of which is connected to the central hub 70 by one of the radial arms 72 and each of which has an outer face 76 conforming to the cylindrical wall 42. As the driving piston 50 and the driving blade 60 are driven axially, these axially extending guides 74 help to guide the driving piston 50 and the driving blade 60 along the cylindrical wall 42 and serve to prevent tilting of the driving piston 50 and the driving blade 60 from the axis to any significant degree.

Figure 4:
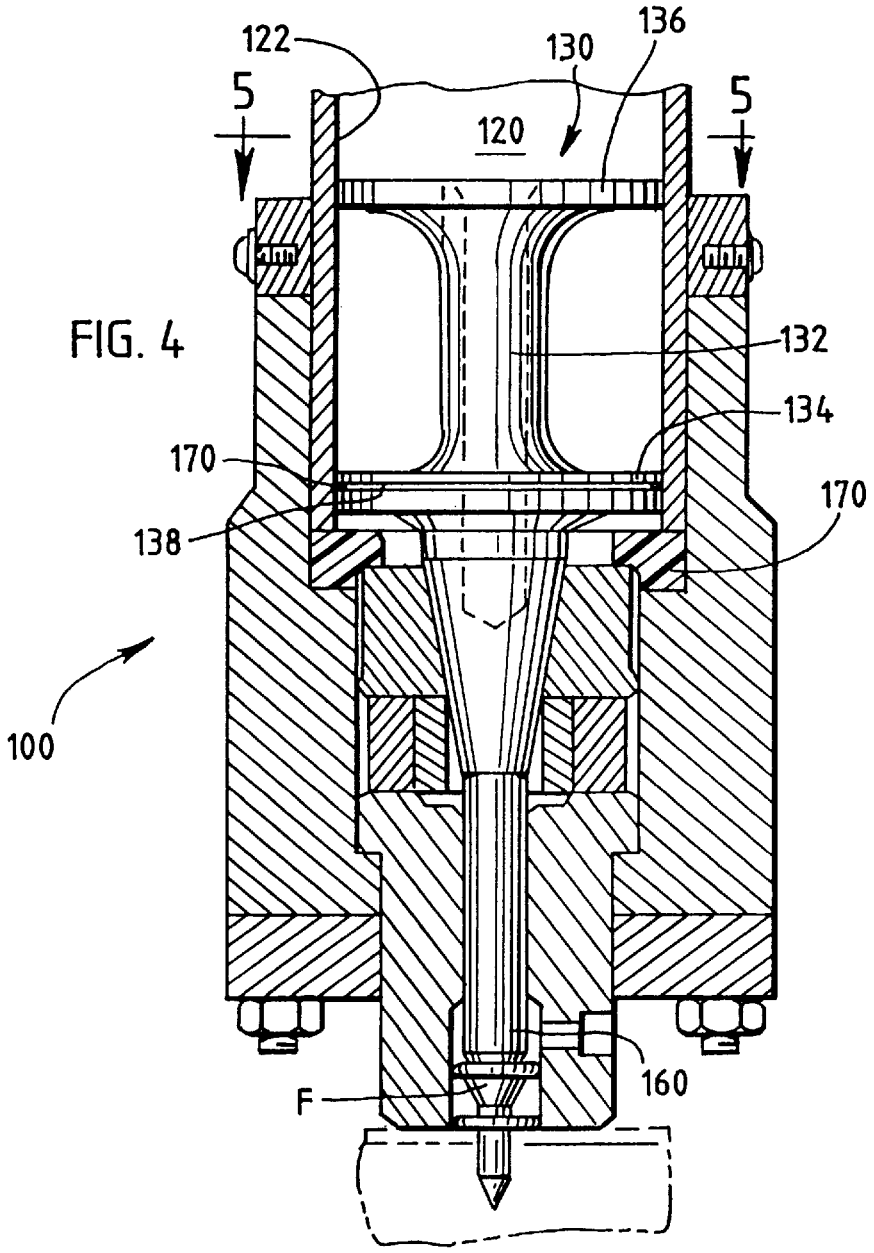
FIG. 4, on a similar scale, is a fragmentary, cross-sectional view taken through an axis of a high velocity, combustion-powered, fastener-driving tool constituting an alternative embodiment of this invention.

As shown schematically in FIGS. 4 and 5, a high velocity, combustion-powered, fastener-driving tool 100 of the type noted above constitutes an alternative embodiment of this invention. The tool 100 is designed to drive fasteners exemplified by the illustrated fastener F of a type exemplified in Almeras et al. U.S. Pat. No. 4,824,003 and Dewey et al. U.S. Pat. No. 5,193,729. Except as illustrated and described herein, the tool 100 may be substantially similar to the tool 10 and to one of the combustion-powered, fastener-driving tools disclosed in Nikolich U.S. Pat. Nos. Re. 32,452 and No. 5,197,646, supra.

The tool 100 comprises structure defining a combustion chamber (not shown) along with structure defining a piston chamber 120 having an inner, cylindrical wall 122, a driving piston 130 movable axially within the piston chamber 120 over a stroke between an initial position, which is an upper position in the drawings, and a terminal position, which is a lower position in the drawings. The driving piston 130 is shown in the terminal position.

Furthermore, the tool 100 comprises a driving blade 160, which is mounted to the driving piston 130 so as to be conjointly movable with the driving piston 130. Generally, the terminal position is defined by an annular, elastomeric bumper 170, which is arranged to arrest the driving piston 130 as the driving piston 130 and the driving blade 160 approach the terminal position.

As shown, the driving piston 130 has a central hub 132 between two axially spaced, annular portions 134, 136, a leading one of which 134 has an annular groove 138 with a piston ring 170 seated in the annular groove 138 and engaging the inner, cylindrical wall 122. Also, the trailing portion 136 has four generally cylindrical openings 180, so as to reduce the mass of the driving piston 130.

Figure 6:
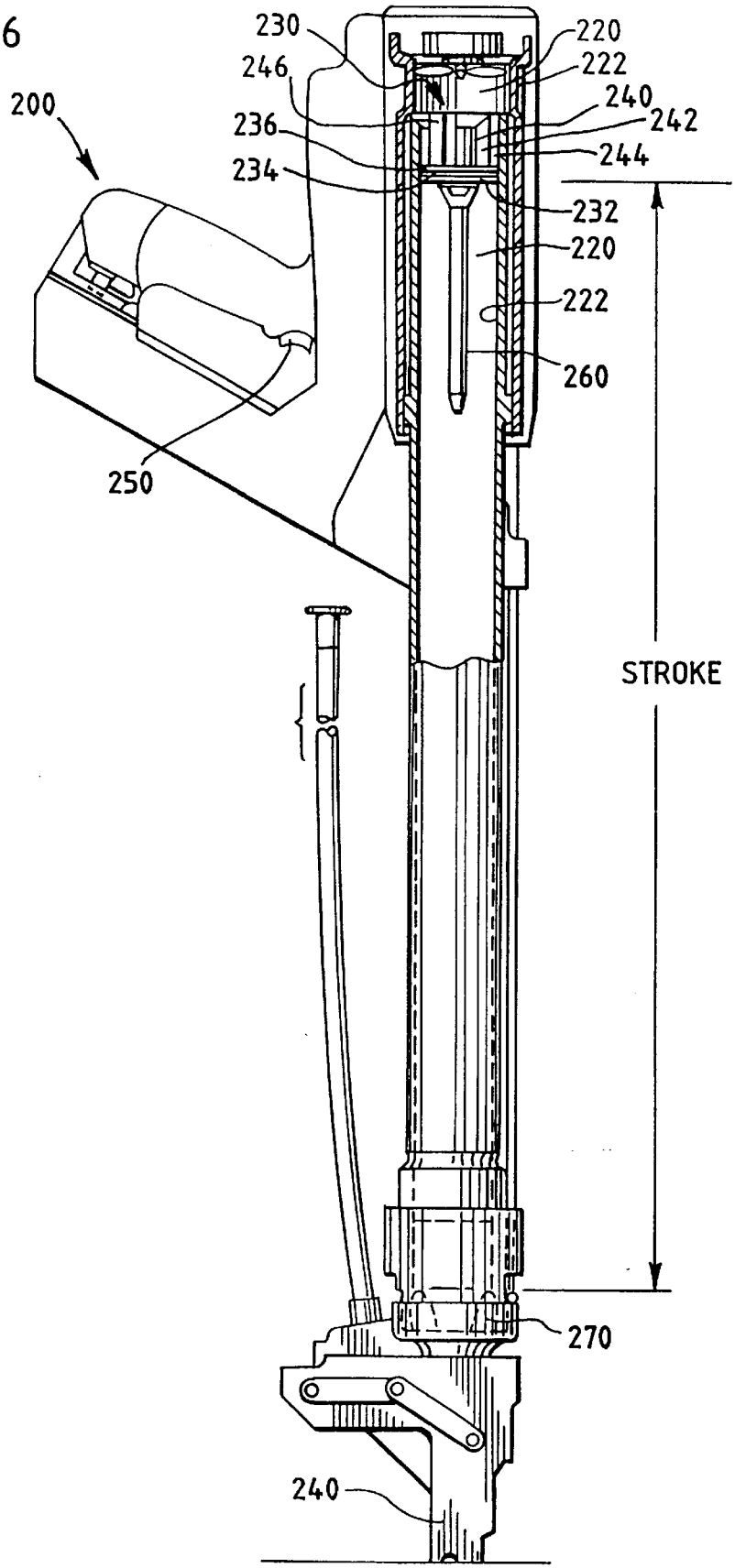
FIG. 6 is a simplified, longitudinal section taken through a high velocity, combustion-powered, fastener-driving tool constituting a preferred embodiment of this invention.

As shown in FIG. 6, a combustion-powered, fastener-driving tool 200 for driving fasteners like the fastener F shown in FIG. 4 constitutes a preferred embodiment of this invention. The tool 200 is similar to the tools described above, particularly the tool 10, and comprises structure defining a combustion chamber 210, structure defining a piston chamber 220 having an inner, cylindrical wall 222, a driving piston 230 movable axially within the piston chamber 220 over a stroke between an initial position, which is an upper position in the drawings, and a terminal position, which is a lower position in the drawings.

Being similar to the driving piston 50, the driving piston 230 has an annular portion 232 with an annular groove 234, in which a piston ring 236 is seated. The piston ring 236 engages the inner, cylindrical wall 222, so as to provide a gas-tight seal between the driving piston 230 and the cylindrical wall 222 as the driving piston 230 and the driving blade 260 are driven axially. The driving piston 230, which has a small mass, has a central hub 240, which trails the annular portion 232, three radial arms 242, which radiate from the central hub 240, and three axially extending guides 244, each of which is connected to the central hub 240 by one of the radial arms 242 and each of which has an outer face 246 conforming to the cylindrical wall 222.

The tool 200 comprises means including a workpiece-contacting element 240 for sensing when the tool 200 is pressed against a workpiece, for enabling the tool 200 when the tool 200 is pressed against a workpiece, and for disabling the tool 200 when the tool 200 is not pressed against a workpiece, means including a trigger 250 for initiating combustion of a gaseous fuel mixed with air in the combustion chamber 30 when the trigger is actuated. Details of the means including the workpiece-contacting element 240, the means including the trigger 240, and other elements of the tool 200 are outside the scope of this invention and can be readily supplied by persons having ordinary skill in the art from the Nikolich patents noted above and from other sources.

Furthermore, the tool 200 comprises a driving blade 260, which is mounted to the driving piston 230 so as to be conjointly movable with the driving piston 230. Generally, the terminal position is defined by an annular, elastomeric bumper 270, which is arranged to arrest the driving piston 230 as the driving piston 230 and the driving blade 260 approach the terminal position.

The second aspect of this invention, as described above, may prove to be also advantageous in a pneumatically powered, fastener-driving tool of a type exemplified in Golsch U.S. Pat. No. 4,932,480, as well as in a combustion-powered, fastener-driving tool.

Various modifications may be made in the illustrated embodiments described above without departing from the scope and spirit of this invention.

We claim:

1. A combustion-powered, fastener-driving tool comprising structure defining a combustion chamber having a combustion chamber volume, structure defining a piston chamber communicating with the combustion chamber, a driving piston movable within the piston chamber between an initial position and a terminal position, and a driving blade mounted to the driving piston so as to be conjointly movable with the driving piston, wherein the driving piston, the driving blade, and the piston chamber are arranged so that combustion in the combustion chamber imparts energy to the driving piston and the driving blade so as to drive the driving piston and the driving blade from the initial position toward the terminal position, through a piston displacement volume, with the driving blade preceding the driving piston, wherein the driving piston has an axial length and wherein the driving piston, the driving blade, and the piston chamber are arranged so that the driving piston and the driving blade are guided solely within the axial length of the driving piston, the driving blade being free of guiding contact over at least substantially all of a stroke between the initial position of the piston and the terminal position of the piston driven by combustion in the combustion chamber, wherein the ratio of the piston displacement volume to the combustion chamber volume is between approximately 0.6:1 and 7.5:1.

2. The tool of claim 1 wherein the piston chamber has an inner, cylindrical wall and wherein the driving piston has an annular portion with an annular groove, in which a piston ring is seated and engages the inner, cylindrical wall.

3. The tool of claim 1 wherein the piston chamber has an inner, cylindrical wall and wherein the driving piston has two axially spaced, annular portions, at least one of which has an annular groove with a piston ring seated in the annular groove and engaging the inner, cylindrical wall.

4. The tool of claim 1 wherein a ratio of the stroke to a piston diameter is between approximately 1.5:1 and 20.5:1.

5. The tool of claim 4 wherein the ratio of stroke to piston diameter is between approximately 3.5:1 and 14.5:1.

6. A combustion-powered, fastener-driving tool comprising structure defining a combustion chamber having a combustion chamber volume, structure defining a piston chamber communicating with the combustion chamber, a driving piston movable within the piston chamber between an initial position and a terminal position, and a driving blade mounted to the driving piston so as to be conjointly movable with the driving piston, wherein the driving piston, the driving blade, and the piston chamber are arranged so that combustion in the combustion chamber imparts energy to the driving piston and the driving blade so as to drive the driving piston and the driving blade from the initial position toward the terminal position, through a piston displacement volume, with the driving blade preceding the driving piston, wherein the ratio of the piston displacement volume to the combustion chamber volume is between approximately 1.3:1 and 5.1:1, and a ratio of a stroke of the piston to piston diameter is between approximately 3.5:1 and 20.5:1, the stroke measured between the initial position and the terminal position.

7. The tool of claim 6 wherein the ratio of the piston displacement volume to the combustion chamber volume is approximately 3:1.

8. The tool of claim 7 wherein the ratio of stroke to piston diameter is approximately 7.5:1.

9. The tool of claim 6 wherein the driving piston has an axial length and wherein the driving piston, the driving blade, and the piston chamber are arranged so that the driving piston and the driving blade are guided solely within the axial length of the driving piston, over at least substantially all of a stroke between the initial position of the piston and the terminal position of the piston.

10. The tool of claim 6 wherein the ratio of the stroke to piston diameter is between approximately 3.5:1 and 14.5:1.

* * * * *

UNITED STATES PATENT AND TRADEMARK OFFICE

CERTIFICATE OF CORRECTION

PATENT NO.: 5,975,397

DATED : November 2, 1999

INVENTOR(S): Donald L. Van Erden; Kui-Chiu Kwok; G. Michael Velan

It is hereby certified that error appear(s) in the above-identified patent and that said Letters Patent is hereby corrected as shown below:

On the title page, in the identification of the inventors, "Volan" should read --Velan--.

Signed and Sealed this

Fifth Day of September, 2000

*Attest:*

*Attesting Officer*

Q. TODD DICKINSON

*Director of Patents and Trademarks*